United States Patent [19]

Liebhardt et al.

[11] Patent Number: 4,573,411

[45] Date of Patent: Mar. 4, 1986

[54] SAFETY DEVICE FOR A WEAPON DETONATOR OR FUSE

[75] Inventors: Josef Liebhardt, Schrobenhausen; Rudolf Fuhrer, Baar, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 614,833

[22] Filed: May 29, 1984

[30] Foreign Application Priority Data

Jun. 11, 1983 [DE] Fed. Rep. of Germany ..... 3321191

[51] Int. Cl.[4] ..... F42C 15/34

[52] U.S. Cl. ..... 102/256; 102/222; 102/254

[58] Field of Search ..... 102/254, 256, 258, 260, 102/221, 222

[56] References Cited

U.S. PATENT DOCUMENTS

| | | | |
|---|---|---|---|
| 2,666,388 | 1/1954 | Wheeler | 102/254 |
| 3,313,236 | 4/1967 | Lohmann | 102/256 |
| 4,155,306 | 5/1979 | Herold et al. | 102/254 X |
| 4,173,932 | 11/1979 | Matte et al. | 102/254 |

FOREIGN PATENT DOCUMENTS

| | | | |
|---|---|---|---|
| 1558740 | 1/1980 | United Kingdom | 102/256 |
| 2025005 | 1/1980 | United Kingdom | 102/256 |

*Primary Examiner*—David H. Brown

*Attorney, Agent, or Firm*—W. G. Fasse; D. H. Kane, Jr.

[57] ABSTRACT

A compact safety device for a fuse or detonator for a weapon such as a ballistic projectile to be fired or launched from a tube, is protected against the propellant charge gas pressure by a lightweight, yet pressure tight housing provided with double closure members. One arming detonator element out of a chain of such elements is mounted on a rotor in the pressure tight housing. The rotor is rotatable between an armed position and a disarmed position. The rotation of the rotor is controlled by separate safety elements so that the fuse or detonator can be armed only when it is installed in a weapon.

5 Claims, 8 Drawing Figures

SAFETY DEVICE FOR A WEAPON DETONATOR OR FUSE

FIELD OF THE INVENTION

The invention relates to a safety device for a detonator or fuse for a weapon such as a shell or a ballistic projectile to be fired or launched out of a tube or barrel.

DESCRIPTION OF THE PRIOR ART

Detonators or fuses of this type comprise a detonation chain of serially connected detonating elements arranged axially one behind the other. One of these detonating elements can be tilted or swung out of the detonation chain to change the detonator from an armed state to a safety or disarmed position. The tiltable element is inserted in a rotatable rotor which can be locked into a safety position by a spring force.

In such detonators which are inserted into a shell or ballistic projectile, it is necessary that suitable means are available to protect the shell or ballistic projectile against unwanted triggering. Such means are, for example, tiltable members journalled for swinging out of the detonation chain and locking mechanisms for these members. Various embodiments of such means are part of the prior art. Depending on the particular purpose or use, various solutions and their development for the safety devices have been suggested.

OBJECTS OF THE INVENTION

In view of the above it is the aim of the invention to achieve the following objects singly or in combination:

to construct a safety device for a shell or ballistic projectile detonator or fuse which guarantees the locking of the movable parts of the detonation chain even in case of a malfunction during firing;

to construct the detonator housing to have the required strength and sealing ability against the propellant charge gas-pressure arising during the firing or launching;

to keep the weight of the part of the safety device connected to the shell or projectile preferably to a minimum;

to construct the safety device in such a way that it cannot be armed outside a shell or projectile; and to make sure that the arming elements can be operated in an axial direction.

SUMMARY OF THE INVENTION

The safety device according to the invention comprises two separate locking units for locking a rotor carrying a detonator element, into a disarmed position in which the detonator element is held out of a detonator chain or series. The unlocking or arming of the fuse or detonator is accomplished by two axially effective arming assemblies. The first axially effective arming assembly includes a locking pin constructed to be manually pulled out, thereby permitting a spring to bias the rotor through a lever and an interlocking member or first arresting member (23) toward the armed position. The second axially effective arming assembly is operated electrically to move a push rod which withdraws a second arresting member by bending to thereby permit the spring bias to move the rotor into the armed position.

Further, the structure of the rotor in its housing is such that a stop for holding the rotor in its armed position, is effective only when the detonator or fuse is installed in a shell or projectile, otherwise the rotor keeps rotating back into the disarmed position. Additionally, a partially armed shell or projectile cannot be inserted into a launching device because the spring biased lever moves into a position in which it prevents such insertion or at least provides an indication that the device is partially armed to alert the operator.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
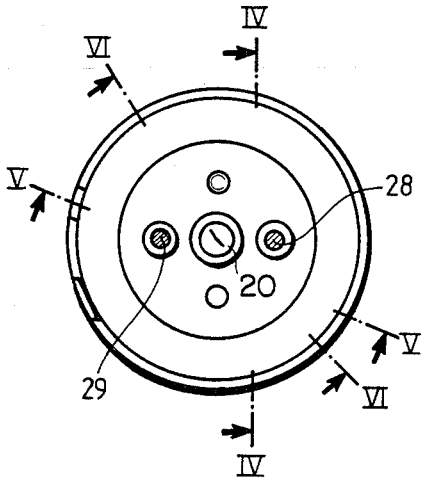
FIG. 1 is a top view onto the example embodiment of a safety device according to the invention, as viewed in the direction of the arrow A in FIG. 2.
Figure 2:
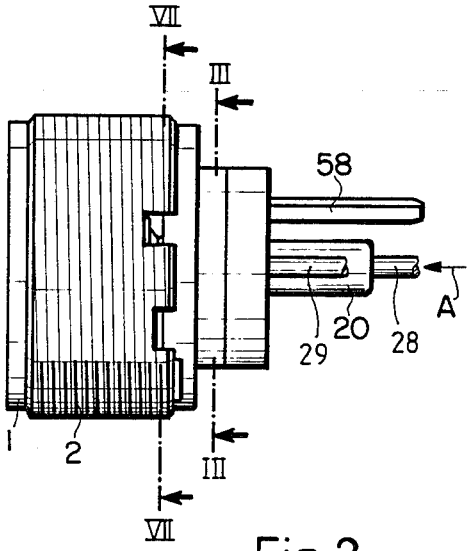
FIG. 2 is a side view of the safety device of FIG. 1.
Figure 3:
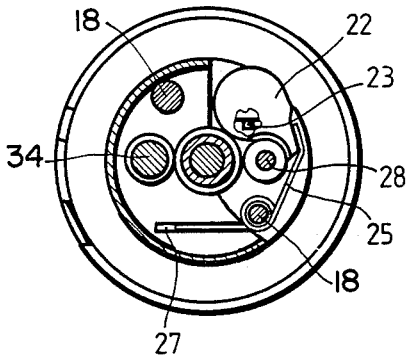
FIG. 3 is a cross-section through FIG. 2 along section line III—III.
Figure 4:
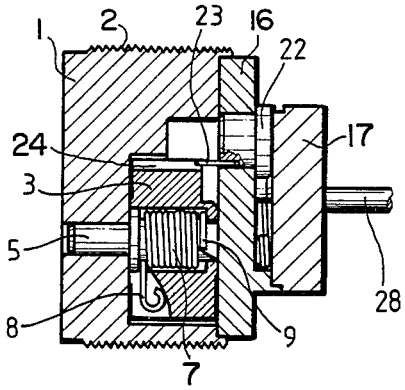
FIG. 4 is a cross-section through FIG. 1 along section line IV—IV.
Figure 5:
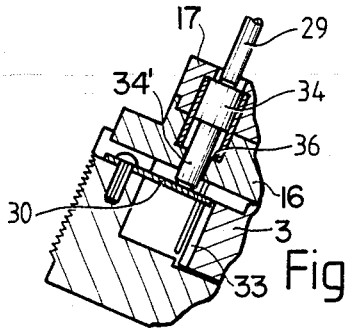
FIG. 5 is a partial sectional view through FIG. 1 along section line V—V.

Referring to FIGS. 1 and 2, the entire safety device is installed in a housing 1 made of high strength metal. The housing 1 has an outer threading 2 by means of which the safety device is screwed into a jacket 51 of a shell or projectile. A rotor 3 is pivoted or journalled on an axis 5 in the housing 1. A shank or leg 8 of a torsion spring 7 grips the rotor 3 while the second spring shank or leg 9 is propped against or secured to the axis 5. A detonator element 10 is secured in the rotor 3 in such a way that in the disarmed position the element 10 is located 180° opposite the detonation inducer 12. In this disarmed position the element 10 rests over a blow-out channel 13, see FIG. 6. The housing 1 is closed off by an intermediate plate 16 and a cover plate 17, that are held by at least one screw 18. This closure structure seals the housing 1 in a pressure-tight manner.

To achieve the desired gas-pressure resistance or crush strength, it is necessary that the safety device has several interlocking intermediate members mounted so that they are at least partially encased in the plates 16 and 17. An arming lever 22 is journalled without play in the intermediate plate 16. An arresting or interlocking member in the form of a bolt 23 is eccentrically forced into the lever 22 and engages into a first interlocking recess 24 in the rotor 3. A spring 25 is mounted in the intermediate plate 16 and is supported there with one leg in a slot 27 and engages the lever 22 with its other end or leg. The lever 22 is locked against rotation by a locking pin 28 which is mounted in the cover plate 17 and serves as the first safety mechanism which is a first axially effective arming assembly which simultaneously holds the lever 22 and the rotor 3 because these two members are interlocked by the interlocking bolt 23.

An electrical tripping device 29 built into a closure element 48 acts as the second safety mechanism or second arming assembly including intermediate members. When this tripping device 29 is activated by an armature or the like not shown, it presses a piston 34 of a push rod 34' against a stop shoulder 36 in the intermediate plate 16 to thereby bend a locking or arresting member 30, whereby the member 30 is moved or bent out of a second locking recess 33 of the rotor 3 to thereby free the rotor 3 so that it rotates in the direction of the arrow 43 under the biasing force of the spring 7 to move the detonator element 10 into the armed position 37 defined by the butting of edge 46 against the stop element 38. In the armed position the detonator element 10 is arranged in series with a detonation inducer 12 and a detonation delay member 20.

The stop element 38 is under the pressure or bias of a spring 40 urging the stop element 38 outwardly through an opening 39 in the housing 1. However, as long as the rotor 3 is held in the safety or disarmed position, it keeps the stop member 38 inside the housing 1 by the projection 41 projecting into a contact slot 42 in the stop element 38. When the rotor 3 rotates about 15° in the direction of arrow 43, the stop element 38 is freed because the projection 41 moves out of the slot 42, whereby element 38 moves to butt against the inner threading of the shell or projectile jacket 51. Such inner threading cooperates with the threading 2. In case the rotor 3 is released from the safety position when it is not inserted in a projectile or shell, the stop element 38 moves out through opening 39 and is blocked against being pushed back into the housing 1 by the profile of a milled slot 47 by means of an automatic locking feature of the free shank or leg of the spring 40. Thus, it is impossible to press the stop element 38 back into the housing 1, and hence it is impossible to insert the armed safety device into a shell or projectile. Further, when the stop element 38 projects out of opening 39, the rotor 3 does not have a stop for the armed position, whereby it continues to rotate past the armed position back into the safety position, thus providing an added safety feature.

Yet, a further safety feature is provided in that the lever 22 pivots under the mounting hole of the locking pin 28 when the latter is pulled out, whereby the insertion of a ballistic projectile with an armed safety device into a cup discharger or launching or firing tube is prevented.

Figure 6:
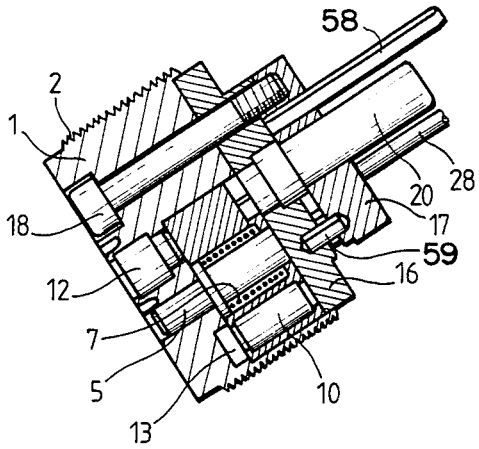
FIG. 6 is a cross-section through FIG. 1 along section line VI—VI.
Figure 7:
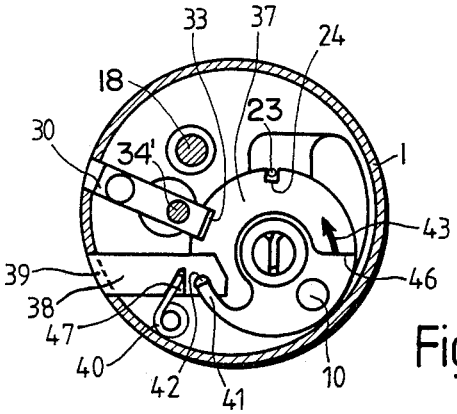
FIG. 7 is a cross-section through FIG. 2 along section line VII—VII showing the rotor in the disarming position.

Referring specifically to FIG. 6, a split sleeve pin 58 is secured with one end thereof in a hole of the cover plate 17. The pin 58 engages into a hole in the closure 48 (FIG. 8) for properly defining the position of the safety device relative to the closure 48. Thus, the pin 58 also prevents a relative rotation between the closure 48 and the safety device which is important so that the locking pin 28, the arming or safety member 29, and the delay device of the detonator or fuse may be properly aligned with the respective holes in closure 48. Similarly, the split sleeve 59 properly orients the cover plates 16 and 17 relative to each other and aids in the assembly of these plates 16, 17 and the housing 1.

Figure 8:
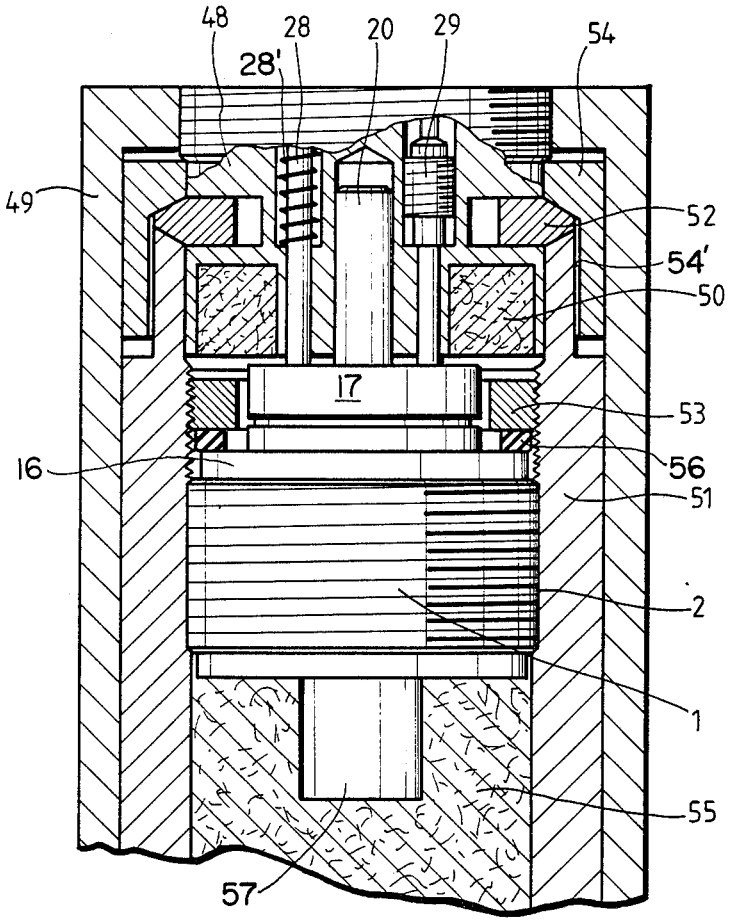
FIG. 8 shows a cross-section through a portion of a launching or firing tube and through a projectile or shell inserted into the launching tube, whereby the present safety device is installed in the shell or projectile or grenade.

Referring to FIG. 8, the projectile or shell with its jacket 51 is shown inserted into a launching cup, tube or barrel 49 closed by the closure 48 through which the locking pin 28 extends outwardly for manual pulling out against the force of a spring 28' for preparing the arming or as the first arming step. The safety device with its housing 1 is screwed into the jacket 51 and held in place by a threaded counter ring 53 pressing against the housing closure plate 16 through an elastic sealing ring 56. The cover plate 17 faces a deforming charge 50 housed in the closure 48 for sufficiently deforming the plates 16 and 17 upon launching so as to rigidly lock the rotor 3 and thus the detonator element 10 into the armed position 37 for avoiding blind shells or so-called duds. The closure 48 is releasably secured to the jacket 51 by locking segments 52 held in place by a threaded bushing 54 threadedly engaging the jacket 51 at 54'. The locking segments 52 move radially inwardly in response to pressure generated by the deforming charge 50, whereby the shell or projectile is released from the closure 48. A fuse proper or ignition member 57 reaches into a projectile or shell charge 55 for firing or detonating the shell after a predetermined delay time adjustable by the detonation delay element 20. Incidentally, the charge 50 also functions for expelling the shell or projectile or grenade from the tube 49.

The present device operates as follows. Before the launching or firing, the ballistic projectile with the safety device screwed into the shell, grenade or the like as described above, is placed into a launching or firing tube 49 as shown in FIG. 8, whereby the safety members 28 and 29 are held in the closure element 48. To prepare for launching or firing, first the locking pin 28 is pulled out manually, thereby freeing the lever 22 so that the lever 22 is now only held by the rotor 3, due to the arresting bolt 23 against rotation by the force of the spring 25. Thereafter, the electrical tripping device 29 is activated to press the locking member 30 out of the rotor locking recess 33 by means of its thrust force that acts upon the push rod 34' through the piston 34, whereby the rotor 3 swings into the armed position 37 by means of the force of its torsion spring 7 and the propellant charge 50 can now be ignited. The gas-pressure generated by this charge 50 retracts the segments 52 and ignites the detonation delay element 20 which after a predetermined burn-time ignites the projectile charge 55 by means of the detonator element 10 and the detonation inducer 12 which ignites the fuse or ignition member 57.

The special advantages of the invention are seen in that the safety device has features for preventing unwanted detonations or firings, that the safety elements thereof remain in the launching or firing device after the launching or firing, and in that the safety device is built into a compact housing that is constructed so that its movable parts are blocked or locked by the cover plate which is deformed for this purpose by the gas-pressure caused by the detonation of the propellant charge 50 at launching or firing.

Although the invention has been described with reference to specific example embodiments, it will be appreciated, that it is intended to cover all modifications and equivalents within the scope of the appended claims.

What is claimed is:

1. A safety device for a fuse or detonator for a weapon, comprising housing means, a detonator chain including a plurality of detonator elements arranged in series, means for rotating one detonator element (10) out of and into said detonator chain for respectively disarming or arming the fuse or detonator, said means for tilting comprising a rotor member (3) operatively supported in said housing means and carrying said one detonator element for rotation between a disarmed position and an armed position, rotor arresting means cooperating with said rotor member for arresting said rotor member in the disarmed position, said rotor member comprising a first locking recess (24) and a second locking recess (33), said rotor arresting means comprising a first arresting member (23), a spring biased lever (22) journalled in said housing means and operatively connected to said first arresting member (23) for arresting said rotor in said disarmed position when said first arresting member (23) is engaged in said first locking recess (24), whereby said spring biased lever is held in a locking position by its spring bias, said rotor arresting means further comprising a second arresting member (30) operatively engaging said second locking recess (33) also for arresting said rotor in said disarmed position, a push rod (34) operatively arranged for cooperation with said second arresting member (30), and electrically operable tripping means (29) operatively arranged for operating said push rod for removing said second arresting member out of its rotor arresting position, said rotor member (3) having a stop shoulder (46), said safety device further comprising a spring biased stop element (38) operatively mounted in said housing means for providing a stop for said stop shoulder (46) when said rotor is in said arming position, an opening (39) in said housing means for passing said spring biased stop element (38), when said fuse or detonator is outside a weapon, at least partially out of said housing means and out of the way of said stop shoulder (46), whereby said rotor can move past the armed position back into the disarmed position while said fuse or detonator is outside a weapon, said spring biased stop element (38) comprising means for blocking said stop element (38) against movement back into said housing once the stop element sticks out of said housing means, said device further comprising interengaging means (41, 42) between said stop element (38) and said rotor member (3) for holding said stop element inside said housing means against its spring bias as long as said one detonator element (10) is in its disarmed position, whereby said fuse or detonator can be effectively armed only inside a weapon.

2. The device of claim 1, wherein said means for blocking comprise a spring (40) which is so arranged that it biases said stop element (38) out of said opening (39) when said fuse or detonator is being armed outside a weapon, and that it blocks said stop element (38) into a rotor stopping position when said fuse or detonator is installed in a weapon.

3. The device of claim 1, wherein said electrically operable tripping means (29) for said push rod are operatively mounted in a closure member (48) for a weapon launching tube, said device further comprising a locking pin (28) for said spring biased lever (22), said locking pin also being mounted in said closure member (48) for a weapon launching tube, said tripping means (29) and said locking pin (28) forming safety elements reaching into said safety device as long as a propellant charge (50) is not ignited.

4. The device of claim 1, wherein said housing means further comprise housing closure members (16, 17), said device further comprising propellant charge means operatively arranged for permanently deforming said closure members for holding said rotor member (3) and said spring biased lever (22) in said armed position after said propellant charge has been ignited in a weapon.

5. The device of claim 4, wherein said closure members comprise an intermediate plate (16) and a cover plate (17) for sealing said housing means in a pressure tight manner against said propellant charge.

* * * * *